US005386606A

United States Patent [19]

Haselwander

[11] Patent Number: 5,386,606

[45] Date of Patent: Feb. 7, 1995

[54] YARN DYEING METHOD

[75] Inventor: Jack G. Haselwander, Chattanooga, Tenn.

[73] Assignee: Manufacturing Designs & Solutions, Inc., Chattanooga, Tenn.

[21] Appl. No.: 224,320

[22] Filed: Apr. 7, 1994

Related U.S. Application Data

[62] Division of Ser. No. 91,644, Jul. 14, 1993, Pat. No. 5,339,658.

[51] Int. Cl.[6] ..... D06B 1/14

[52] U.S. Cl. ..... 8/149

[58] Field of Search ..... 68/203, 202; 101/172; 118/247, 249; 8/149

[56] References Cited

U.S. PATENT DOCUMENTS

| | | | |
|---|---|---|---|
| 1,488,298 | 3/1924 | Thomayer | 68/203 X |
| 1,583,577 | 5/1926 | Coleman | 68/203 |
| 1,930,986 | 10/1933 | Shaffner | 68/203 X |
| 2,160,300 | 5/1939 | Baldwin | 68/203 |
| 2,573,097 | 10/1951 | Epstein | 68/203 |
| 3,083,640 | 4/1963 | Milner | 101/172 |
| 3,304,862 | 2/1967 | Lawrence et al. | 101/172 |
| 3,434,456 | 3/1969 | Geating | 118/247 X |
| 3,541,958 | 11/1970 | Keown | 68/203 X |
| 3,871,196 | 3/1975 | Matsunaga | 68/203 |
| 3,879,966 | 4/1975 | Worth et al. | 68/203 |
| 4,020,194 | 4/1977 | McIntyre et al. | 118/247 X |

FOREIGN PATENT DOCUMENTS

| | | | |
|---|---|---|---|
| 6815 | 5/1893 | Switzerland | 68/202 |

*Primary Examiner*—Philip R. Coe
*Attorney, Agent, or Firm*—Alan Ruderman

[57] ABSTRACT

A method and apparatus for space dyeing a plurality of strands of yarns which are fed over a series of dye applicator rolls. Each roll is rotated in a partly submerged condition in a dye pan containing a different color. Above and offset relative to each dye applicator roll is a yarn pattern roll which carries a number of slats in a circumferential array extending beyond the periphery of the pattern rolls for contacting the yarn strands. The slats sequentially engage and deflect the yarn strands onto the surface of the respective dye applicator rolls. The slats may be positioned in selected slots in the pattern rolls to determine the pattern of color applied to the yarn. Variable speed drives rotate the dye applicator rolls and the pattern rolls independently of each other to effect the spacing of the colors and the amount of dye received by the yarn strands.

6 Claims, 3 Drawing Sheets

YARN DYEING METHOD

This application is a division, of application Ser. No. 08/091,644, filed, Jul. 14, 1993, and now U.S. Pat. No. 5,339,658.

BACKGROUND OF THE INVENTION

This invention relates to space dyeing apparatus and more particularly to apparatus for applying dye to a plurality of yarn strands in a preselected array or pattern of color, spacing and length in a continuous manner and for selectively controlling the array, spacing and amount of dye applied to the yarn.

In some fabrics, such as carpets, it is desirable to provide yarns which have a color pattern varying along their lengths. Such yarns have come to be known as space-dyed yarns, and apparatus and processes for coloring such yarn are known as space-dyeing apparatus and processes. Carpet fabrics made from yarns of this type generally have a multicolor effect with no visible pattern. Various space-dyeing methods and apparatus have been known in the prior for some period of time. See for example, Epstein U.S. Pat. No. 2,573,097. Such methods and apparatus include systems where a number of yarns pass over a series of dye applicator rollers or drums which are charged with dyes of various colors. The yarns generally are controlled during passage over the drums so as to maintain clearance with the surfaces except when it is desired to color a portion of the yarn. When a portion of the yarn is to be colored the yarn is depressed by a presser member to cause the yarn to be pressed against the surface of the selected dye applicator roller. The presser member may be a piston or plunger reciprocating above the dye applicator roller for forcing the yarn directly against the periphery of the dye applicator roller as disclosed in Farrer et al U.S. Pat. No. 3,503,232 and Worth et al U.S. Pat. No. 3,879,966, or may be a series of pads mounted on a rotating drum, the pads forcing the yarn against the dye applicator roller as in Keown U.S. Pat. No. 3,541,958. Thus, in the prior art the yarn is stamped, impacted or hammered against the dye applicator roller. If the plunger or pad is held against the yarn for too long a time, the feeding of the yarn may be impaired. Thus, the amount of dye applied to the yarn during each impact is limited.

In Farrer et al and Worth et al the speed of the dyeing is limited because of the limitations on the reciprocating elements including the cycling and the acceleration forces involved.

In the Keown and Worth et al patents the yarn is precolored with a base color and the stamping effectively results in the dye applicator rollers applying spots of secondary color on the precolored yarn. Complicated control systems, both mechanical and electrical, are proposed for varying the spacing between the secondary colors applied. In Farrer et al random repeat may be obtained by an electro-mechanical system of cams and switches for controlling solenoids which act as plungers. Such complicated control systems were apparently proposed because the stamping, impacting or hammering of the yarn only applies color to the yarn during that limited portion of the cycle when the yarn is disposed between the piston, plunger or pad and the dye applicator roller.

When a pattern change or change in variegation of colors along the yarns is desired, Keown appears to require a major overhaul or replacement of elements and Worth et al requires replacement or reprogramming of electrical circuitry. Only Farrer et al requires a repositioning of mechanical members which form raised portions on the surface of cylindrical cams and thus can be performed by non-highly skilled maintenance personnel. However, such repositioning of cam elements merely effects the engagement of the plungers which force the yarns against the dye applicator rollers which include the aforesaid limitations. Moreover, since the cam elements act to control micro switches which activate the plungers, and the switches may open and close a number of times each revolution, switch maintenance and replacement may be common.

SUMMARY OF THE INVENTION

Consequently, it is a primary object of the present invention to provide space-dyeing apparatus wherein a plurality of yarn strands may be continuously colored by application of a number of different yarn colors to provide various color arrays along the yarn strands.

It is another object of the present invention to provide yarn space-dyeing apparatus wherein the pattern or array of colors along a plurality of strands of yarn fed through the apparatus may be readily and conveniently changed.

It is a further object of the present invention to provide space-dyeing apparatus wherein a plurality of yarn strands pass over a number of dye applicator rolls, each applicator roll being positioned within a dye pan containing a different respective color, the apparatus having pattern rolls including repositionable replaceable slats for deflecting the strands of yarn onto the peripheries of the dye applicator rolls.

It is a still further object of the present invention to provide space-dyeing apparatus wherein a plurality of yarn strands pass over a number of dye applicator rolls positioned within respective dye pans, the apparatus having pattern rolls including repositionable slats disposed within selective slots in the peripheries thereof for engaging and deflecting the strands of yarn onto the peripheries of the dye applicator rolls, the amount of dye on the yarn and the spacing of the colors along the yarn being controlled by varying independently the speed of the dye applicator rolls and the speed of the pattern rolls while the placement of the colors is varied by changing the circumferential disposition of the slats on the pattern rollers.

Accordingly, the present invention provides a method and apparatus wherein a plurality of strands of yarn are fed and pass over a series of dye applicator or lick rolls, each of which is partly submerged in a dye pan or vat containing a different color and driven by a variable speed drive to apply dye to the yarn when the yarn is forced onto the dye applicator rolls. Depending upon the speed of the dye applicator rolls, different amounts of dye are applied to the yarns which travel in a horizontal plane. Above and offset relative to each dye applicator roll is a yarn pattern or control roll which carries slats in a circumferential array extending from the periphery of the respective pattern rolls for deflecting the yarn strands onto the respective dye applicator rolls. The slats in each roll may be positioned in various slots in the pattern rolls to determine the pattern of color on the yarn. Variable speed drive means drive the pattern rolls independently of variable speed drive means that drive the dye applicator rolls. The length of yarn colored by a particular color may be controlled by the speed of the pattern rolls relative to the speed that the yarns are fed, and the amount of dye applied to the yarn may be controlled by the speed of the dye applicator rolls relative to the speed at which the yarn is fed through the apparatus.

The slats are positionable within any of a plurality of slots formed longitudinally within the peripheries of the respective pattern rolls and may be changed readily to vary the pattern array. Since the slats deflect the yarn onto the surfaces of the dye applicator rolls rather than stamp the yarn against the rolls a greater amount of dye may be applied to the yarn while the length of the yarn containing a particular color may be increased without hammering the dye applicator rolls.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
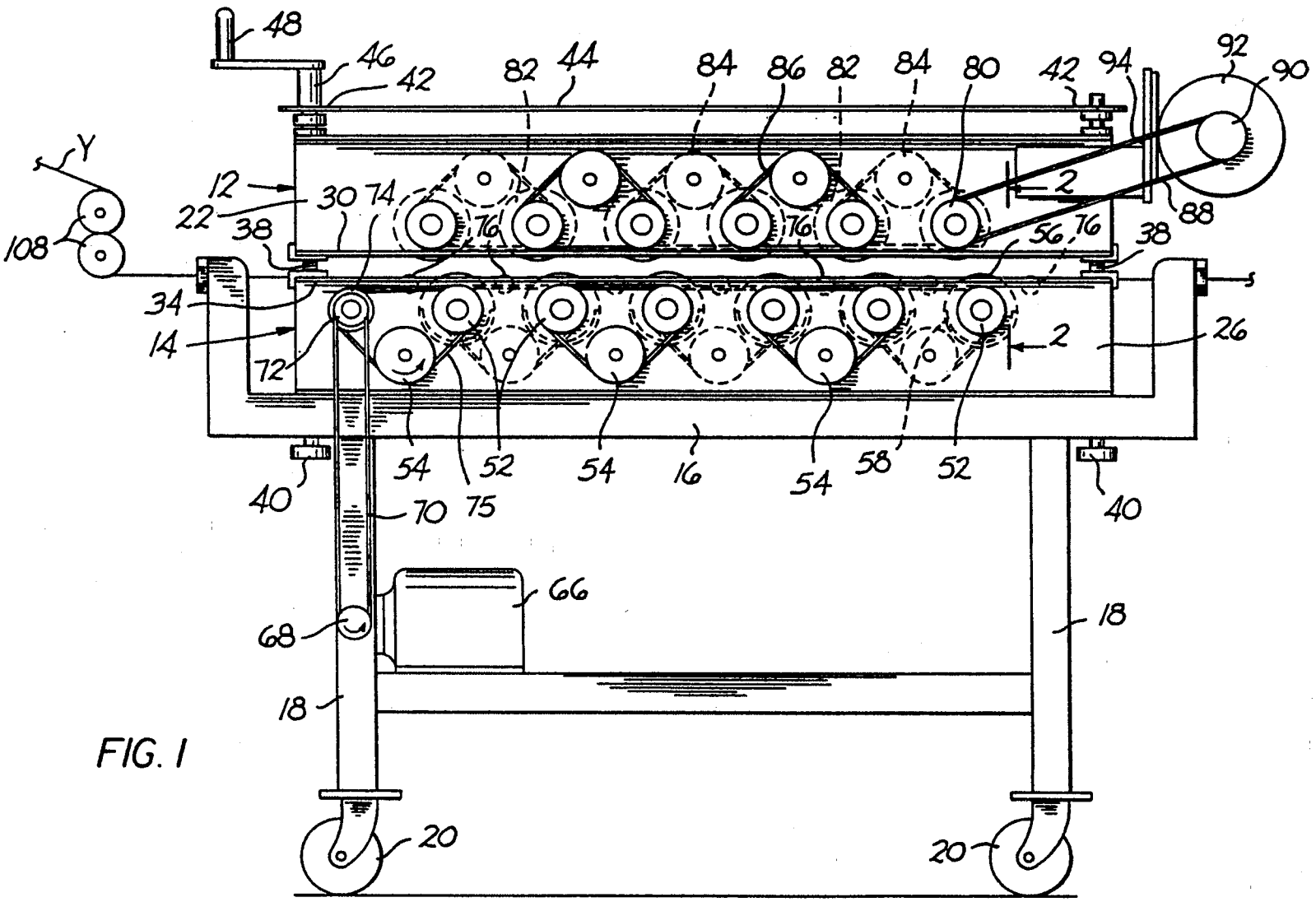
FIG. 1 is a side elevational view with portions thereof removed of dyeing apparatus constructed in accordance with the present invention illustrated in an inoperative position.

Referring to the drawings, dyeing apparatus 10 constructed in accordance with the principles of the present invention include an upper head 12 and a lower head 14 carried on a supporting base plate 16. As illustrated, the base plate 16 together with the heads may have a substantially rectangular configuration, the base plate preferably including upstanding legs 18 supported on wheels 20 so that the apparatus may be mobile if desired. The upper head 12 includes a pair of laterally spaced apart beam members 22, 24 forming an upper frame while the lower head 14 includes a similar pair of laterally spaced apart beam members 26, 28 forming a lower frame. Each upper beam 22, 24 has an externally directed lateral flange 30, 32 respectively while each lower beam 26, 28 has a similar flange 34, 36 respectively, the flanges 30, 32 being disposed on the respective flange 34, 36 in the operative position illustrated in FIG. 2. In the inoperative position of the apparatus, the flanges 30, 32 are separated from the flanges 34, 36 as illustrated in FIG. 1. In order to raise and separate or lower and close the upper head relative to the lower head a lead screw 38 is provided adjacent each corner of the upper head 12 threaded through a number of blocks and collars in the upper head 12 and in the lower head 14 in conventional manner and secured to a stop collar 40 below the lower head. Each lead screw carries a sprocket 42 about which a chain 44 is trained. One of the lead screws, as illustrated in FIG. 1, is secured to a sleeve 46 which is formed together with a crank arm and handle 48 so that manual rotation of the handle 48 rotates all of the lead screws 38 and raises or lowers the upper head 12 selectively relative to the lower head 14.

Figure 2:
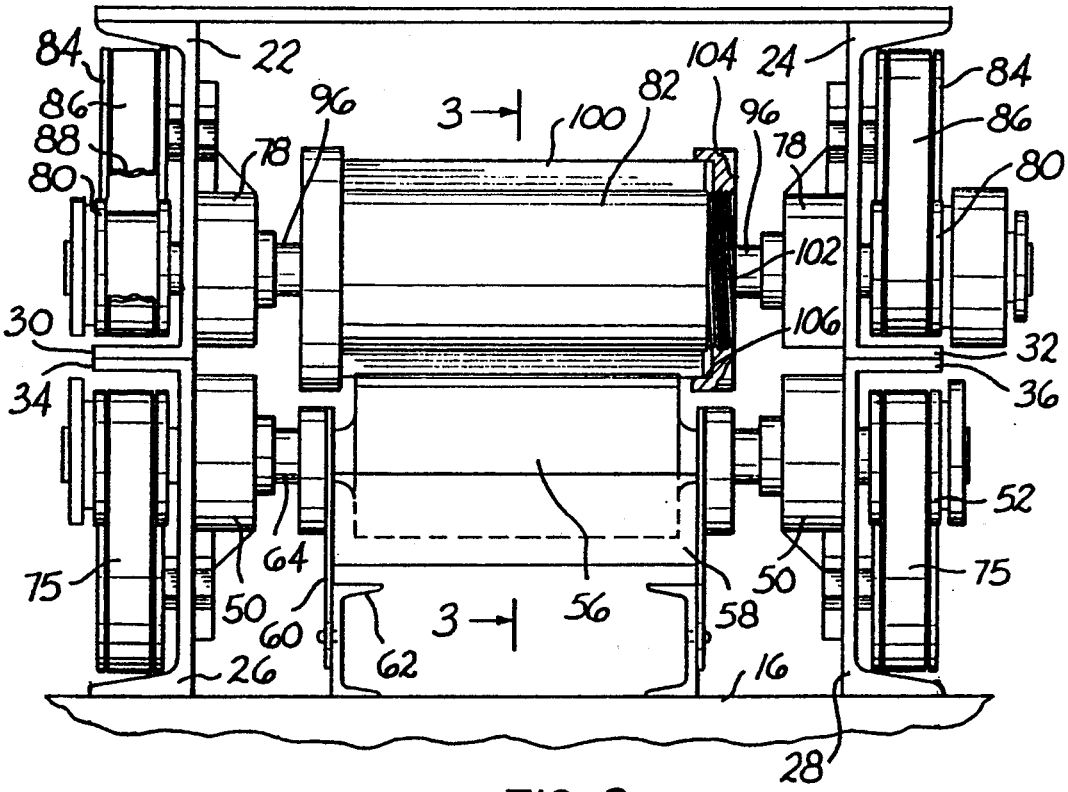
FIG. 2 is an enlarged vertical cross sectional view taken substantially along line 2—2 of FIG. 1 but with the apparatus in the operative position.

Rotatably journalled in bearings, such as bearings 50 illustrated in FIG. 2, mounted on the interior face of the beams 26, 28 of the lower housing 14 is a plurality of pulleys 52 and 54. The axes of the pulleys 52 are disposed above and offset in staggered fashion relative to the axes of the pulleys 54 as illustrated in FIG. 1. Each pulley 52 is coupled to one end of a respective, preferably stainless steel, dye applicator roll 56 adjacent to and externally of each beam 26, 28, while the pulleys 54 alternate from one side to the other, i.e., alternate pulleys 54 are adjacent to and external of the beam 26 while the remaining pulleys are externally of the beam 28. Each dye applicator roll 56 is disposed between the beams 26 and 28 within a corresponding dye pan 58 having sidewalls 60 which are adjustably and removably supported on channel beams 62 fastened to the base plates 16. The rolls 56 have or are coupled to axles 64 which exit through the sidewalls of the respective pan in sealed fashion for coupling to the pulleys 52 as aforesaid. The pulleys 54 act as idler pulleys for purposes hereinafter made clear.

Mounted in the base below the base plate 16 is a variable speed motor 66, which may be a motor connected to a variable speed drive, which is coupled to a pulley 68 for driving the same. A timing belt 70 is trained about the pulley 68 and another pulley 72 journalled in the lower head 14 above the pulley 68, the pulley 72 being mounted on a common shaft with another pulley 74 disposed at the same side of the apparatus as the adjacent idler pulley 54, i.e., adjacent the beam 26 as illustrated in FIG. 1. A timing belt 75 is trained about the pulley 74, the adjacent idler pulley 54 and the adjacent applicator roll coupled pulley 52 thereby to rotatably drive the applicator roll 56 coupled thereto. The pulley 52 at the opposite end of that roll, i.e., the end adjacent the beam 28, drives the pulley on that same side of the next adjacent applicator roll by means of a belt trained about those two pulleys and the idler roll disposed therebetween. Each subsequent applicator roll 56 is driven in a similar manner from the preceding applicator roll, the driving pulley alternating from side-to-side. It may be noted that the applicator rolls rotate in the direction opposite to that in which yarn strands Y are fed at the upper periphery of the rolls, i.e., the yarns are fed from the left to the right in FIG. 1 while the rolls 56 rotate counter-clockwise. Although any number of selected applicator rolls may be utilized in the dyeing apparatus of the present invention, six such rolls are illustrated in the preferred embodiment illustrated in the drawings, each applicator roll 56 being disposed within a respective dye pan 58 containing a particular dye color which preferably differs in each pan.

Mounted in the lower housing behind each dye application roll 56 and in front of the first dye applicator roll is a yarn support member 76 of a small cylindrical form. Each yarn support member, which is preferably formed from stainless steel, is disposed with its upper peripheral surface at or slightly above that of the dye applicator rolls so that yarn may be fed over the members 76, without contacting the dye applicator rolls with pressure. Thus, the yarn may be fed over the dye applicator rolls without having dye applied to it.

Mounted on the beams 22 and 24 of the upper head 12 are a plurality of pairs of bearings 78, each of which rotatably supports a pulley 80 at each exterior side of the respective beam 22, 24 in a similar manner to the bearings 50 and the pulleys 52 of the lower head 14. Coupled to and between each pair of pulleys 80 and disposed intermediate the beams 22, 24 is a respective pattern roll 82, there being one pattern roll 82 corresponding to each dye applicator roll 52 for reasons hereinafter described in detail. Additionally, a plurality of idler pulleys 84 similar to the idler pulleys 54 are mounted on respective axes above and offset from the axes of the pulleys 80, alternate idler pulleys 84 being disposed adjacent to and externally of the beam 22 and the others being disposed adjacent to and externally of the beam 24. A timing belt 86 is trained about each idler pulley 84 and the pulleys 80 of the two adjacent pattern rolls at the same side of the apparatus in the same manner as the pulleys and belts in the lower head. One of the pulleys 80 at one end of the apparatus, i.e., the rear end as illustrated in FIG. 1, is driven by a timing belt 88 trained about that pulley and another pulley 90 mounted on the output shaft of a variable speed motor 92, or a motor connected to a variable speed drive, secured by bracket means 94 to the beam at the corresponding side of the apparatus, such as the beam 22 as illustrated. Thus, the motor 92 drives the pattern rolls 82 at a selected speed independent of the speed at which the dye applicator rolls 56 are driven by the motor 66. The direction in which the rolls 82 rotate is the same as that of the dye applicator rolls 56 so that at the lower peripheries the rolls 82 move in the same direction as that in which the yarn is fed.

Figure 3:
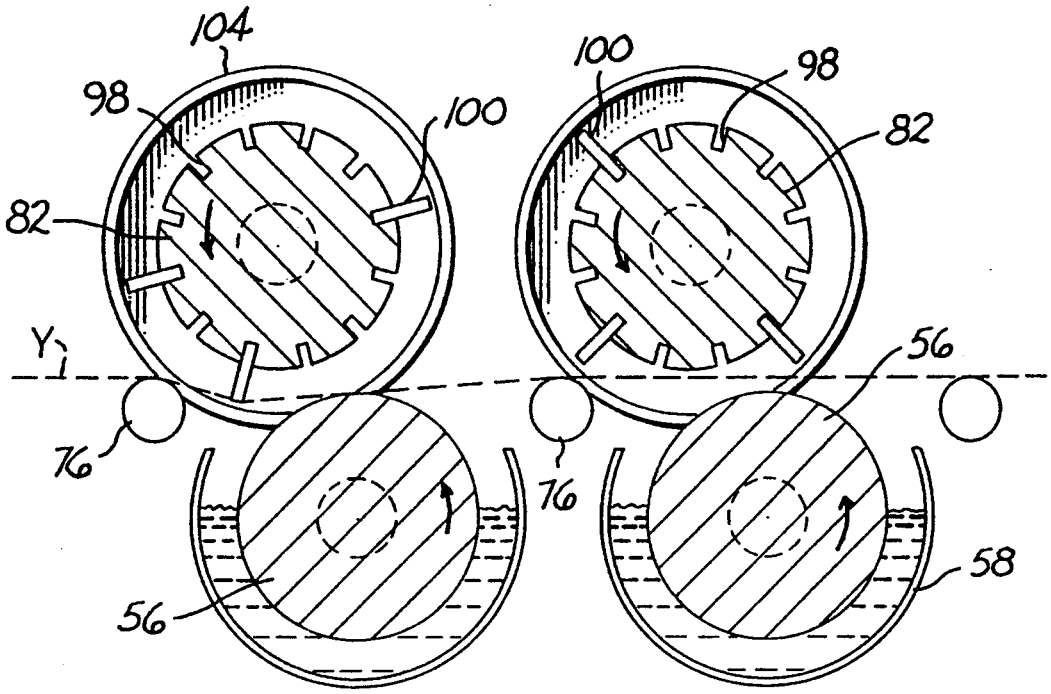
FIG. 3 is a fragmentary vertical cross sectional view taken substantially along line 3—3 of FIG. 2.
Figure 4:
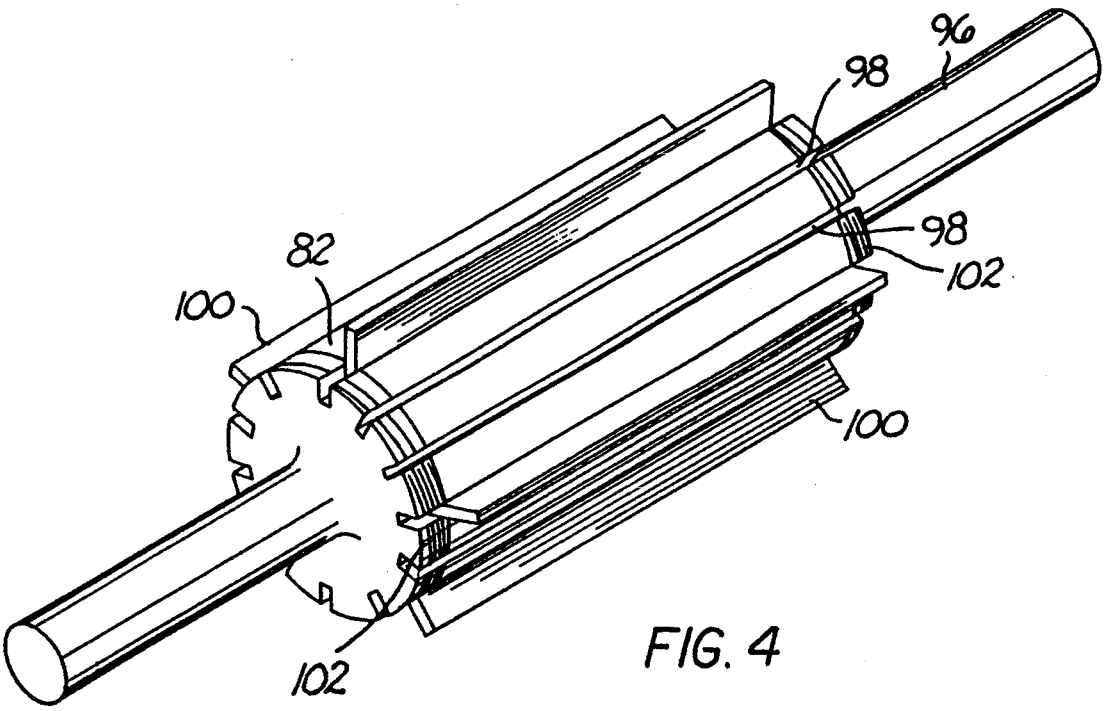
FIG. 4 is a fragmentary perspective view illustrating a pattern roll with the end caps removed.
Figure 5:
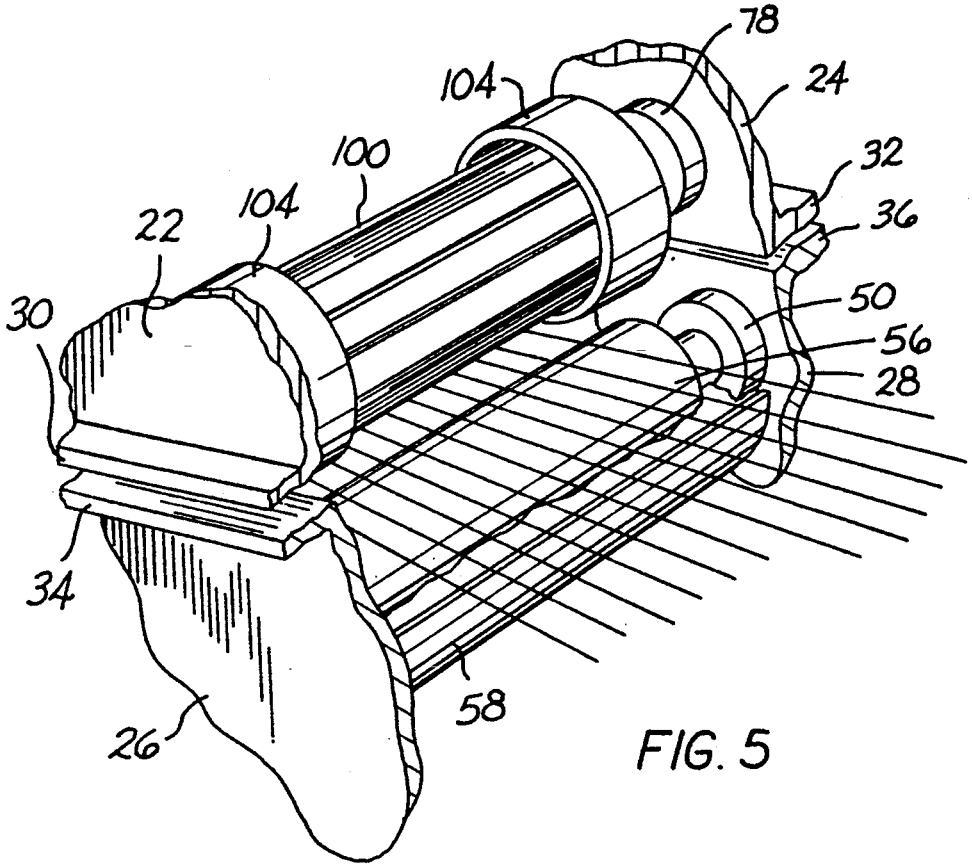
FIG. 5 is a fragmentary perspective view of a portion of the apparatus illustrating a pattern roll and a dye applicator roll.

As illustrated in FIGS. 3 and 4, the pattern rolls 82 comprise cylindrical members having an integral axis 96 at each end and preferably formed from stainless steel. Machined radially into the periphery of each roll 82 extending longitudinally the length of the rolls is a plurality of equally spaced apart slots or grooves 98, each slot being adapted to receive a control slat 100. Although the number of slats may vary with the size of the roll and range up to approximately 36, in a prototype apparatus the diameter of the rolls 82 were in the order of approximately 3 inches and contained 24 slots, each slot having a depth of approximately 0.25 inch and a width of approximately 0.125 inch, while each slat was approximately 0.75 inch in width and seated in the selected slots so as to extend approximately 0.50 inch beyond the periphery of the rolls 82. The number of slats 100 and the selected slots within which the slats are positioned is dependent upon the dyeing or printing pattern to be applied to the yarn since the slats deflect and force the yarn against the dye applicator roll corresponding to that pattern roll.

In order to maintain the slats 100 within the selected slots 98, the periphery at the ends of the pattern rolls 82 are threaded as illustrated at 102 in FIGS. 2 and 4 for threadely receiving a respective internally threaded cap 104, the cap having an annular rim 106 including an internal diameter adapted for receiving the slats 100 mounted in the roll 82 within the annulus. The caps 104 preferably are formed from two half or split ring members connected together by screw means (not illustrated) or the like so that the slats may be removed, additional slats inserted, and/or repositioned without disassembly and removal of the roll 82 from the upper housing.

As illustrated in FIG. 3, the axis of each pattern roll 82 is offset from the axis of the corresponding dye applicator roll 56. For a pattern roll with the aforesaid dimensions and a dye applicator roll having a diameter approximately equal to that of the dye applicator roll, the offset is approximately 1 inch. Thus, the slats 100 carried by a particular pattern roll 22 do not stamp or hammer the yarn into the dye applicator roll, but deflect the yarn Y from its normal path over the yarn supports 76 into engagement with the cooperating dye applicator roll 56. Thus, feeding of the yarn is not retarded when a series of adjacent slats deflect the yarn onto an applicator roll to effect a substantial amount of dye of a particular color distributed by wiping onto the yarn. Nor does it retard feeding nor stretching of the yarn when a first color is wiped on at a first station at substantially the same time as other colors are wiped on at other stations.

In practicing the method of the present invention, the yarn is fed through the apparatus by conventional means such as feed rolls 108 at a selected speed. The speed of the pattern rolls as effected by the drive system including the motor 92 in connection with the speed of the yarn through the apparatus determines the length or space colored by a particular dye. The speed of the dye applicator rolls 56 as determined by the lower head drive system including the motor 66 together with the speed of the yarn through the apparatus controls and determines the amount of dye applied to the yarn. If more dye is needed on the yarn, the speed of the applicator rolls 56 is increased and vice versa. If the space filled by a particular color on the yarn is to be shortened, the pattern roll speed is increased and vice versa. Repositioning slats so that more or less slats are disposed in a particular pattern roll and the position of the slats in a particular pattern roll, determines the location of a particular color and in conjunction with the speed of the pattern roll determines the space on the yarn filled by a particular color. The direction of rotation of the rolls 56 and the rolls 82 is the same so that the applicator rolls drive dye into the yarn fibers and the slats 100 deflect the yarn toward the rolls 56. Since the slats upon contact with the yarn strands move in the same direction as the yarn, wear on the slats is held to a minimum.

Accordingly, there is provided a dyeing apparatus which effects space dyeing of yarn and controls the pattern of the space dyeing by a simple mechanical control comprising replaceable slats in the surface of the pattern rolls. Additionally, the amount of dye and spacing of colors of yarn may be readily controlled merely by changing the speeds of the pattern rolls and the dye applicator rolls independently of each other.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of space dyeing yarn comprising feeding strands of yarn from an upstream station to a downstream station in a horizontal path above the surfaces of a plurality of spaced apart dye applicator rolls, rotating each roll through a respective dye pan about a first axis of rotation to apply a selected respective dye to the surface of each roll, disposing a selected number of paddles on a drum disposed above and upstream of each dye applicator roll, rotating each drum about an axis of rotation parallel to said first axis to sequentially move each paddle into and out of said path while upstream of each corresponding roll for contacting and deflecting the strands of yarn into frictional engagement with the surface of the corresponding dye applicator roll to transfer dye from the surface of said roll to said yarn strands.

2. In the method as recited in claim 2, including rotating said dye applicator rolls at variable selected speeds, and rotating said drum at variable selected speeds independently of the speeds of said rolls.

3. In the method as recited in claim 1, wherein said drums and said rolls rotate in the same direction, and said paddles while contacting said yarn strands move in the direction in which the yarn strands are being fed.

4. A method of space dyeing yarn comprising feeding strands of yarn from an upstream station to a downstream station in a horizontal path above the surface of a dye applicator roll, rotating said roll through a dye pan about a first axis of rotation to apply a selected dye to the surface of said roll, disposing a selected number of paddles at selected locations on a drum disposed above and upstream of said dye applicator roll, rotating said drum about an axis of rotation parallel to said first axis to sequentially move each paddle into and out of said path while upstream of said roll for contacting and deflecting the strands of yarn into frictional engagement with the surface of the dye applicator roll to transfer dye from the surface of said roll to said yarn strands.

5. In the method as recited in claim 4, including rotating said dye applicator roll at a selected speed, and rotating said drum at a selected speed independently of the speed of said roll.

6. In the method as recited in claim 4, wherein said drum and said roll rotate in the same direction, and said paddles while contacting said yarn strands move in the direction in which the yarn strands are being fed.

* * * * *